US006789868B2

(12) United States Patent
Hata et al.

(10) Patent No.: US 6,789,868 B2
(45) Date of Patent: Sep. 14, 2004

(54) CONTAMINATION PREVENTING METHOD DURING CONVEYANCE OF RECORDING MEDIUM OF IMAGE FORMING APPARATUS, AND IMAGE FORMING APPARATUS

(75) Inventors: Kenshi Hata, Tokyo (JP); Shigeru Watanable, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 10/082,202

(22) Filed: Feb. 26, 2002

(65) Prior Publication Data

US 2002/0122088 A1 Sep. 5, 2002

(30) Foreign Application Priority Data

Feb. 28, 2001 (JP) ..... 2001-054586

(51) Int. Cl.[7] ..... B41J 29/38

(52) U.S. Cl. ..... 347/16; 347/5

(58) Field of Search ..... 347/5, 16, 14, 347/19, 104, 105

(56) References Cited

FOREIGN PATENT DOCUMENTS

JP 9-110213 4/1997 ..... B65H/3/52

*Primary Examiner*—Juanita D. Stephens
(74) *Attorney, Agent, or Firm*—Fitzpatrick, Cella, Harper & Scinto

(57) ABSTRACT

The present invention provides a contamination preventing method during the conveyance of a recording medium of an image forming apparatus in which the recording medium is held while conveyed and an image is formed on the recording medium. A contact portion of the recording medium held by the holding member is held only for a predetermined time and the contact portion is changed from time to time, thereby preventing or reducing contamination of the recording medium caused by a recording medium conveying unit regardless of the type of the recording medium.

24 Claims, 1 Drawing Sheet

FIGURE
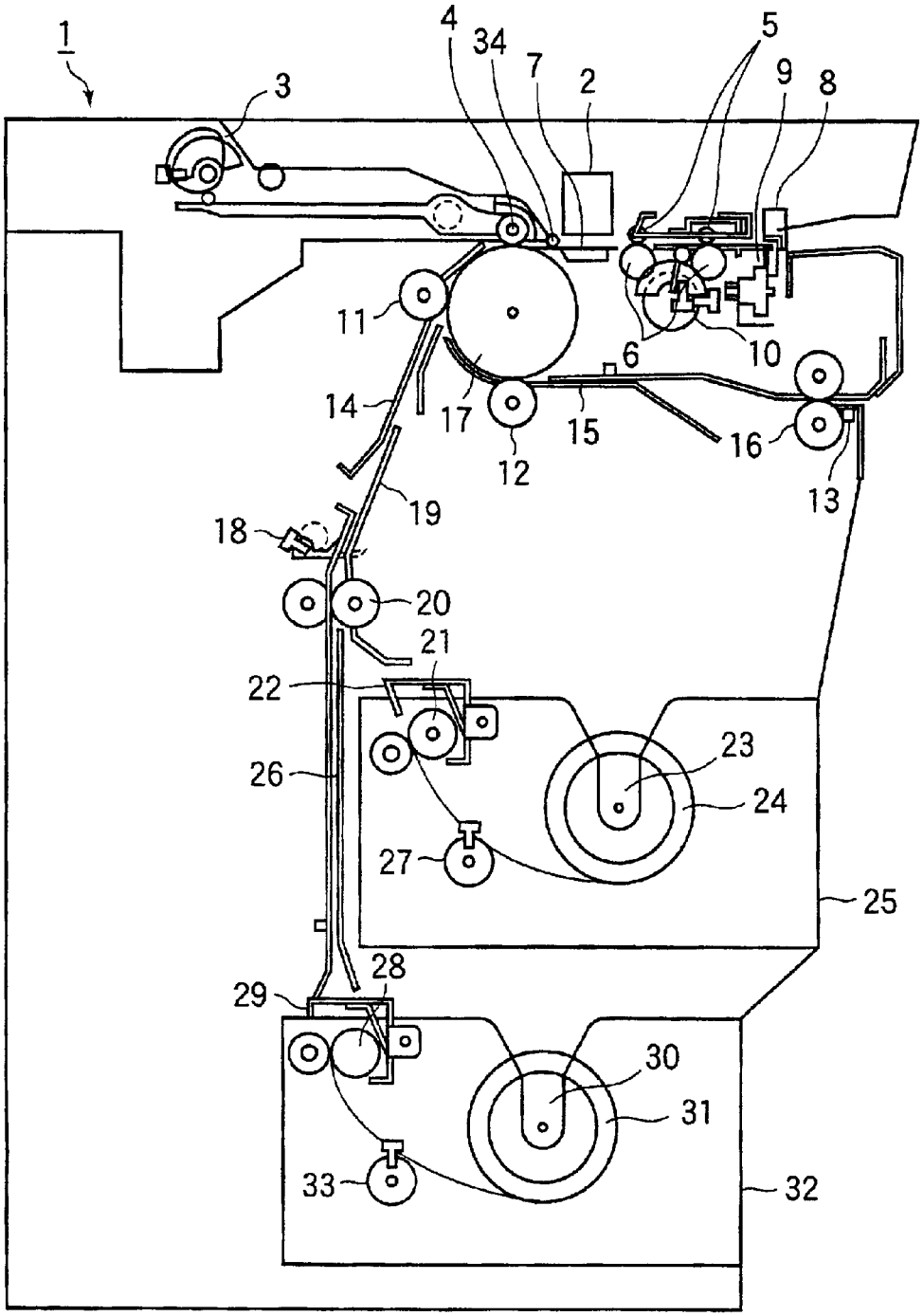

CONTAMINATION PREVENTING METHOD DURING CONVEYANCE OF RECORDING MEDIUM OF IMAGE FORMING APPARATUS, AND IMAGE FORMING APPARATUS

BACKGROUND OF THE INVENTION

1. Field of the Invention

The present invention relates to an image forming apparatus which mainly uses paper, film or cloth as a recording medium and records an image thereon.

2. Related Background Art

Heretofore, as recording methods for forming a monochromatic or color image, there have widely been used an electrophotography method and an ink jet method. Moreover, as a recording medium of these methods, an ink jet sheet is used in addition to ordinary paper. Among the ink jet sheets, there is used a recording paper having a special coating layer on a basic paper body. Such an ink jet sheet is carried to an image formation block normally by a duplo method using a recording medium feed roller and a friction pad or a retard method in which a recording medium is sandwiched by a normal rotation roller rotating in the recording medium conveyance direction and a reverse rotation roller rotating in the reverse direction, so that the paper is separated and supplied using a difference in the friction coefficients of these two rollers.

Moreover, these rollers have been made from a metal material and an elastic member made from urethane rubber.

However, conventionally, when the ink jet sheet is supplied to a predetermined image formation position by the aforementioned method, the ink jet sheet should be sandwiched by rollers to be carried to the image formation block. Moreover, when no image is to be recorded, the paper is usually sandwiched while waiting. Thus, when the paper is in contact with the rollers for a long time, the paper used as a recording medium may be contaminated. Especially in the case of the ink jet sheet, one side of the basic paper body has an absorption layer for absorbing an aqueous ink and this layer is easily contaminated by contact with the rubber roller. In an extreme case, this contamination changes a color of the image which has been recorded by the ink jet method.

Moreover, if sandwiched by the rollers for a long time, the roller causes a roller trace on the ink jet sheet and the roller trace may be seen after the image recording.

These problems extremely degrade the quality of the recorded image.

Moreover, the contamination results are different depending on the roller rubber type. In case of a rubber having a comparatively low hardness, the rubber contains much oil, which may come out from the roller onto the recording medium and contaminate the recording medium making a white spot. On the other hand, in case of a rubber having a comparatively high hardness, when the dedicated paper is in contact with the roller or even when a several—millimeter space is present between them, the dedicated paper is often contaminated with a yellow color portion.

To solve these problems, the roller material has been modified as is disclosed in Japanese Patent Application No. 9-110213. However, the problems cannot be solved sufficiently when a medium other than paper such as a film and a cloth are used as the recording medium.

SUMMARY OF THE INVENTION

It is therefore an object of the present invention to provide an image forming apparatus that can prevent or reduce contamination of a recording medium caused by a recording medium conveying unit, regardless of the type of the recording medium; and a method for preventing contamination during the recording medium conveyance by the recording medium conveying unit.

Another object of the present invention is to provide a contamination preventing method applied during a recording medium conveyance in an image forming apparatus which holds a recording medium while conveying the recording medium and forming an image on the recording medium in such a manner that a contact portion of the recording medium is not held more than a predetermined time and the contact position of the recording medium is changed from time to time.

BRIEF DESCRIPTION OF THE DRAWINGS

The FIGURE is a longitudinal cross sectional view for explaining a recording medium conveying unit of an image forming apparatus according to an embodiment of the present invention and an image contamination preventing method in the conveying unit.

DESCRIPTION OF PREFERRED EMBODIMENTS

Description will now be directed to embodiments of the present invention with reference to the attached drawing.

Firstly, explanation will be given on configuration and operation of a paper feed mechanism (recording medium feed mechanism) in the image forming apparatus according to an embodiment of the present invention. Moreover, explanation will be given on an example of ink jet sheet in a rolled state but the present invention is not limited to this and can be applied to a film and cloth. Moreover, instead of the rolled paper, cut sheets can also be used. Furthermore, this invention can be applied not only to the ink jet-dedicated processed paper but also to any type of recording medium in which discoloration and roller trace may be caused.

FIGURE is a block diagram for explaining an image forming apparatus (hereinafter, referred to a printer) according to the embodiment of the present invention.

In FIGURE, an ink jet type printer 1 has a cassette A25 where a roll-shaped ink jet sheet (hereinafter, referred to as a dedicated paper) having a length of about 100 m and width of about 1.6 m is set. Normally, the tip end of the dedicated paper passes through a sensor A27 and sandwiched by a pair of rollers made from rubber or metal and arranged to oppose each other so as to constitute rolled paper supply roller 21. Thus, paper is waiting for printing.

When an image formation signal is input to the printer 1, the dedicated paper starts to be fed toward a platen 7. Here, in the printer 1, if the dedicated paper is present at the sensor A27, the rolled paper supply roller 21 is driven to convey the dedicated paper to the rolled paper feed rollers 20. Next, a longitudinal pass sensor A18 detects that the dedicated paper has passed the rolled paper feed rollers 20 within a predetermined time. When the sensor cannot detect the dedicated paper within a predetermined time, it is decided that a jam has occurred and a corresponding signal is transmitted to the printer.

After detection by the longitudinal pass sensor A18, the dedicated paper is conveyed along a paper guide D19 and a paper guide A14 and is pressed against a metal feed roller 17 having a surface processed for adjusting a friction force, and the dedicated paper changes its conveyance direction. After this, a cam 3 is driven to apply a pressure to a pressure roller 4 so that the dedicated paper is sufficiently attached to the feed roller 17.

The feed roller 17 is driven by a conveying unit having an accuracy required for image formation and feeds the dedicated paper to the platen 7. Here, an image is formed on the dedicated paper by an ink jet type recording head on a carriage 2. For fixing and drying the image, the paper is conveyed by a dependant conveying roller 5 and a discharge roller 6 so as to be discharged out of the printer. After this, a cutter 8 driven by a drive motor 9 cuts off the dedicated paper. At this moment, the tip end of the rolled paper A24 after cutting off the portion having the image has been fed out to the discharge roller 6 and the rolled paper A24 is returned by a spindle A23 to the cassette A25. Here, the longitudinal pass sensor A18 detects the rolled paper tip end and adjusts the drive force and drive amount so that the rolled paper tip end remains at the rolled paper supply roller 21 of the cassette A25.

The aforementioned operation is also performed when the dedicated paper (rolled paper B31) is fed from a cassette B32 and the rolled paper B31 waits in the cassette B32.

The printer 1 includes a control unit having a sequence for preventing contamination of the recording medium by the rollers during the wait state before image formation and during fixation and drying state after the image formation. The control unit has an electric circuit and a program for executing the contamination preventing sequence.

Hereinafter, explanation will be given on a specific example for preventing contamination of the dedicated paper as a recording medium by the rollers. However, the holding means for holding the recording medium in a conveyance route is not limited to rollers but may include a pad whose surface has a high friction coefficient for holding the recording medium in a conveyance route.

Embodiment 1

Explanation will be given on a method for preventing contamination of the dedicated paper according to a first embodiment.

In the FIGURE, the dedicated paper coming out of the cassette A25 is fed successively by the rolled paper supply rollers 21, the rolled paper feed roller 20, a paper guide 19, and a paper guide 14, and conveying roller 11 and conveyed to the platen 7 where an image formation is performed.

In case of a long-medium printing in which the dedicated paper having an image formed is rolled up, the printer 1 waits in a state that the dedicated paper is sandwiched by the pressure roller 4 and a dependant roller 34. In this example, the position where the tip end of the dedicated paper is sandwiched by the following roller will be referred to as a home position. When the wait time exceeds a predetermined time (5 minutes in this embodiment), the printer sends out the dedicated paper by a predetermined amount (2 mm in this embodiment) by the feed roller 17 and stops. This operation is repeated until the accumulated feed amount is 100 mm. When the accumulated feed amount has become 100 mm, the dedicated paper is returned to the home position and the same operation is repeated. Thus, the portion of the recording medium held by the roller is changed one from another and this prevents contamination of the non-image portion of the recording medium.

During this wait sequence, when the printer 1 receives a print-on signal as an image formation start command, the printer 1 drives the spindle A23 to return the dedicated paper to the home position, i.e., to the dependant roller 34. Here, when the holding portion has reached a predetermined amount (in this embodiment, the aforementioned accumulated feed amount 100 mm), the dedicated paper is returned to the home position. Accordingly, this accumulated feed amount is reduced to a range where the non-recording area of the recording medium is not contaminated. Thus, it is possible to reduce the time for the dedicated paper to return to the home position. After the dedicated paper is returned to the home position, an image formation sequence of the recording medium is started.

Moreover, after an image formation is performed on the platen 7, the dedicated paper having the image is in a stop state while being held by the discharge roller 6 and the dependant conveying roller 5, so that image fixation and drying are performed. In this case, sequence of the aforementioned wait state is performed. This can prevent a prolonged contact between the discharge roller 6 and the dedicated paper, exceeding the predetermined time. Thus, it is possible to prevent contamination of the recording medium (dedicated paper) after the image formation.

It should be noted that in this embodiment, the paper was supplied from the cassette A25. However, the aforementioned contamination preventing operation is substantially identical when the paper is fed from the cassette 32.

Moreover, in this embodiment, the feed amount of the recording medium for a predetermined wait time is a constant value but this feed amount may be irregular. In this case, a boundary with a non-contaminated portion is not at a constant position and as a result, contamination appears unclear.

Embodiment 2

Next, explanation will be given on a contamination preventing method of the dedicated paper according to a second embodiment.

In FIGURE, if the dedicated paper is stored in the cassette A25 for a long time, the dedicated paper is contaminated by the rolled paper supply roller 21 and becomes yellow. For this, in this embodiment, when the dedicated paper is held by the rolled supply roller longer than a predetermined time (60 hours in this embodiment), the printer 1, upon reception of the print-on signal, sends out the dedicated paper by about 50 mm from the position of the cutter 8 and drives the drive motor 9 to cut off a portion of the dedicated paper which has been contaminated during the long wait state. Thus, an image formation on the contaminated portion is prevented. After this, the spindle A23 is driven to the position of the dependent roller 34 which is the image formation start point (home position) so as to return the tip end of the dedicated paper, after which the tip end of the dedicated paper is moved onto the platen 7 for performing an image formation on the recording medium.

It should be noted that in this embodiment the paper is supplied from the cassette A25 but the aforementioned contamination stop operation is substantially identical when the paper is supplied from the cassette B32.

Embodiment 3

Next, an explanation will be given on a method for preventing contamination of the dedicated paper according to a third embodiment.

In FIGURE, when a predetermined time (5 minutes in this embodiment) has passed if no print-on signal as a image formation start command is present and the sensor A27 detects that the dedicated paper is in the cassette 25, the rolled paper supply roller 21 of the cassette A25 sends out the dedicated paper by a predetermined amount (10 mm in this embodiment) toward the rolled paper feed roller 20. When 5 minutes have passed from this moment, the rolled paper supply roller 21 sends out further 10 mm. In this embodiment, this operation is repeated until the accumulated amount exceeds about 200 mm, and the sent-out amount is returned into the cassette 25A for waiting. Moreover, this step is repeatedly performed during the wait state.

When the printer 1 receives the print-on signal as an image formation start command while the aforementioned wait step is performed, the printer 1 drives the spindle A23 to return the dedicated paper to a predetermined position (in this embodiment, the state when the tip end of the dedicated paper is sandwiched by the rolled paper supply roller 21 of the cassette A25) and then image formation is performed onto the recording medium.

It should be noted that in this embodiment, the paper is supplied from the cassette A25 but the even when the paper is supplied from the cassette B32, the aforementioned contamination preventing operation is substantially identical.

Embodiment 4

Next, explanation will be given on a method for preventing contamination of the dedicated paper according to a fourth embodiment.

In the ink jet printer 1 shown in FIGURE, the dedicated paper in the cassette A25 or in the cassette A32 is fed along the rollers 20, 11 and guides 19, 14 onto the platen 7, where an image is formed.

The dedicated paper having the image formed is discharged out for fixation and drying of the image.

Here, in this embodiment, there is a step for discharging out with a blank of about 50 mm from the tip end of the recorded image in the conveyance direction of the dedicated paper, so that there is a blank of about 50 mm between the tip end of the recorded image on the dedicated paper and the cutter 8. During the fixation and drying after the image formation, the rolled paper A224 as a recording medium is continuous to the dedicated paper portion discharged out.

During such fixation and drying, there is provided a step to drive the cam 3 when a predetermined time has passed, so as to reduce the pressure of a pressure roller 4 pressing the dedicated paper against the feed roller 17. Moreover, by driving the cam 10, the dependent conveying roller 5 moved by the discharge roller 6 is separated from the discharge roller 6, thereby forming a space between the dependent conveying roller 5 and the dedicated paper. These processes prevent contamination of the non-image region of the dedicated paper.

Moreover, it is also possible to apply the method of changing the medium holding portion as time passes like in the first and the third embodiment. When this method is used in combination, it is preferable that the pressure roller 4 and the dependent conveying roller 5 be returned to their original states before feeding the dedicated paper. The dedicated paper discharged outside for image fixation and drying may be held/sandwiched by a roller and the like. Thus, when the methods are applied in combination, it is possible not only to avoid the contamination of the non-image region of the dedicated paper but also the image which has been recorded.

After a predetermined drying time of the printer 1 has passed, the drive motor 9 is driven to operate the cutter 8 to cut off the dedicated paper. It should be noted that when the medium holding position change method is used in combination, the dedicated paper is returned to the first drying position (where the tip end of the recorded image on the dedicated paper out of the printer is at 50 mm from the cutter 8) before performing cutting. After this, the spindle A24 or spindle B30 is driven to introduce the dedicated paper into the cassette for waiting.

It should be noted that in this embodiment, explanation has been given on prevention of contamination of the recording medium during fixation and drying after an image formation. However, it is also possible to apply this method to the wait state before an image formation by changing (reducing, including reducing to zero) the pressure of the rollers sandwiching the recording medium as has been described above, thereby changing the roller intrusion amount into the recording medium, so as to prevent image contamination by the roller.

Embodiment 5

Next, explanation will be given on a method for preventing dedicated paper contamination according to a fifth embodiment.

In the ink jet printer 1 shown in FIGURE, the dedicated paper in the cassette A25 or cassette B32 is fed along the rollers 20, 11 and paper guides 19, 14 onto the platen 7 and an image is formed.

The dedicated paper after the image formation is discharged outside for fixation and drying.

Here, in this embodiment, there is provided a step for providing a blank space of about 50 mm from the tip end of the recorded image in the paper conveyance direction when discharging the dedicated paper. During the fixation and drying after the image formation, the rolled paper A24 or the rolled paper B31 is still continuous to the dedicated paper portion discharged outside. Moreover, when performing a long-sheet printing, the dedicated paper discharged outside for image fixation and drying is held and conveyed by a roller or the like and rolled up by a roll unit.

In such a fixation and drying after the image formation, the dedicated paper may be contaminated by the pressure roller 4 and the dependent roller 34. However, when performing a long-sheet printing using a roll unit, it is impossible to cut the dedicated paper in the middle. Accordingly, when the printer 1 has received a print-on signal which is the image formation start command and an image formation is performed, there is a step for setting a length to be contaminated to a predetermined value (about 10 cm in this embodiment) and this length is additionally sent out, so that the contaminated portion is left blank before proceeding to the next image recording.

Moreover, in this embodiment, explanation has been given on a case that the image formation start command is received during the fixation/drying after the image formation. However, even when the image formation start command is received during the wait state before an image formation, it is also possible to send out the contaminated length additionally before performing the next recording.

As has been described above, in the respective embodiments, a portion of the recording medium is held only for a predetermined time and such a portion is changed from one to another, and the holding pressure for holding the recording medium is reduced or released during the wait state before an image formation or during the fixation and drying after the image formation. These steps could prevent or reduce the contamination of the non-image region and the image formation region of the recording medium.

It should be noted that the present invention is not limited to a configuration having a recording head 100, an ink tank 180, 190 but can be applied to a recording apparatus having a single recording head, a color recording apparatus using a plurality of recording heads for recording with different color inks, or a gradation recording apparatus using a plurality of recording heads for recording with one color in different concentrations, or to a combination of these recording apparatuses. The similar effects can also be obtained in these apparatuses.

Furthermore, the present invention can be applied to a configuration using an exchangeable ink cartridge where the recording head and an ink tank are formed as a unitary block; a configuration where a recording head and an ink tank are separately provided and they are connected by an ink supply tube; and any other arrangement of the recording head and the ink tank. The similar effects can also be obtained in these configurations. It should be noted that the present invention can also be applied to an ink jet recording apparatus using a recording head using an electromechanical conversion unit such as a piezo element. Among them, the present invention exhibits especially excellent effects in an ink jet recording apparatus using a recording head for discharging ink using a thermal energy. This is because the recording density can be increased with a high accuracy.

What is claimed is:

1. A holding method for holding a recording medium of an image forming apparatus in which the recording medium is conveyed and an image is formed on the recording medium, said method comprising:

a holding step of holding the recording medium by a holding member without changing a held portion of the recording medium; and a change step of changing the held portion of the recording medium held by the holding member when a duration of said holding step exceeds a predetermined time.

2. The holding method according to claim 1, wherein the change step is performed in such a manner that when the duration of said holding step exceeds the predetermined time, the recording medium is fed by a predetermined distance, so that the held portion held by the holding member is changed to another portion.

3. The holding method according to claim 1, wherein the change step is performed in such a manner that when the duration of said holding step exceeds the predetermined time, the recording medium is fed by a variable distance, so that the held portion held by the holding member is changed to another portion.

4. The holding method according to claim 1, wherein the change step is performed in such a manner that, upon reception of an image formation start command, the recording medium is returned to a predetermined position before starting an image formation.

5. A holding method for holding a recording medium of an image forming apparatus in which the recording medium is conveyed and an image is formed on the recording medium, said method comprising:

a holding step of holding the recording medium by a holding member without changing a held portion of the recording medium; and a cut-off step of cutting off the held portion of the recording medium held by the holding member when a duration of said holding step exceeds a predetermined time.

6. An image forming method for forming an image on a recording medium by a recording means, comprising:

a holding step of holding the recording medium by a holding member without changing a held portion of the recording medium;

a conveyance step of conveying the recording medium until the held portion of the recording medium held by the holding member is passed through the recording means, when a duration of said holding step exceeds a predetermined time; and an image forming step of forming an image on a recording medium by the recording means.

7. A holding method for holding a recording medium of an image forming apparatus in which the recording medium is conveyed and an image is formed on the recording medium, said method comprising:

a holding step of holding the recording medium by a holding member without changing a held portion of the recording medium; and a holding force change step of changing a holding force of the recording medium by the holding member, so as to change a distortion amount of the holding member, when a duration of said holding step exceeds a predetermined time.

8. The holding method according to claim 7, wherein the holding force change step is performed in such a manner that upon reception of an image formation start command, the holding force and the distortion amount are returned to the previous states before performing an image formation.

9. A holding method for holding a recording medium of an image forming apparatus in which the recording medium is conveyed and an image is formed on the recording medium, said method comprising:

a holding step of holding the recording medium by a holding member without changing a held portion of the recording medium; and a holding force release step of releasing a holding force of the holding member when a duration of said holding step exceeds a predetermined time.

10. The holding method according to claim 9, wherein the holding force release step is performed in such a manner that upon reception of an image formation start command, the holding force is returned to the previous state before performing an image formation.

11. A holding method for holding a recording medium of an image forming apparatus in which the recording medium is conveyed and an image is formed on the recording medium, said method comprising:

a holding step of holding the recording medium by a holding member without changing a held portion; and a conveyance/holding step of conveying the recording medium and holding a non-image portion by the holding member when a duration of said holding step exceeds a predetermined time, wherein an image is not formed on the non-image portion.

12. An image forming apparatus comprising:

an image formation block for forming an image on a recording medium;

a holding member for holding the recording medium;

a conveying unit for conveying the recording medium held by said holding member through said image formation block; and control means for performing control in such a manner that a contact portion of the recording medium contacted by said holding member is changed to another contact portion when the contact portion of the recording medium contacted by said holding member has not been changed for a predetermined time.

13. The image forming apparatus according to claim 12, wherein the control means performs control in such a manner that when a duration of holding the recording medium by the holding member exceeds a predetermined time, the recording medium is conveyed by a predetermined distance by the conveying unit.

14. The image forming apparatus according to claim 12, wherein the control means performs control in such a manner that when a duration of holding the recording medium by the holding member exceeds a predetermined time, the recording medium is conveyed by an indefinite distance by the conveying unit.

15. The image forming apparatus according to claim 12, wherein the control means performs control in such a manner that when a holding time of holding the recording medium by the holding member exceeds a predetermined time, the recording medium is conveyed and the holding member is made to hold a non-image portion.

16. The image forming apparatus according to claim 12, wherein the holding member is a roller or pad.

17. The image forming apparatus according to claim 12, wherein the image formation block performs recording on the recording medium using an ink jet recording head for discharging ink.

18. An image forming apparatus having a conveying unit for conveying a recording medium through an image formation block, said apparatus comprising:

a holding member for holding the recording medium;

an image formation block for forming an image on the recording medium held by said holding member; and a cut-off means for cutting off a contact portion of the recording medium contacted by said holding member when the contact portion of the recording medium contacted by said holding member has not changed for a predetermined time.

19. The image forming apparatus according to claim 18, wherein the control means performs control in such a manner that upon reception of an image formation start command, the recording medium is returned to a predetermined position before performing an image formation.

20. An image forming apparatus comprising:

an image formation block for forming an image on a recording medium;

a holding member for holding the recording medium;

a conveying unit for conveying the recording medium held by said holding member through said image formation block; and control means for performing control in such a manner that said conveying unit conveys the recording medium until a contact portion of the recording medium contacted by said holding member passes through said image formation block before performing an image formation, when a contact portion of the recording medium contacted by said holding member has not changed for a predetermined time.

21. An image forming apparatus comprising:

an image formation block for forming an image on a recording medium;

a holding member for holding the recording medium;

a conveying unit for conveying the recording medium held by said holding member through said image formation block; and control means for performing control in such a manner that a holding force of holding the recording medium by said holding member is changed, so as to change a distortion amount of said holding member, when a contact portion of the recording medium contacted by said holding member has not been changed for a predetermined time.

22. The image forming apparatus according to claim 21, wherein the control means performs control in such a manner that upon reception of an image formation start command, the holding force of holding the recording medium by said holding member is returned to the previous state before performing an image formation.

23. An image forming apparatus comprising:

an image formation block for forming an image on a recording medium;

a holding member for holding the recording medium;

a conveying unit for conveying the recording medium held by said holding member through said image formation block; and control means for performing control in such a manner that said holding member is separated from the recording medium when a contact portion of the recording medium contacted by said holding member has not changed for a predetermined time.

24. The image forming apparatus according to claim 23, wherein the control means performs control in such a manner that upon reception of an image formation start command, a pressure of the holding member against the recording medium and an intrusion amount of the holding member into the recording medium are returned to the previous states before performing an image formation.

* * * * *

UNITED STATES PATENT AND TRADEMARK OFFICE

CERTIFICATE OF CORRECTION

PATENT NO. : 6,789,868 B2
DATED : September 14, 2004
INVENTOR(S) : Kenshi Hata et al.

It is certified that error appears in the above-identified patent and that said Letters Patent is hereby corrected as shown below:

Column 2,
Line 40, "FIGURE," should read -- the FIGURE, --.

Column 4,
Lines 29 and 54, "FIGURE," should read -- the FIGURE, --.
Line 55, "a" should read -- an --.

Column 5,
Line 10, "the" (2nd occurrence) should be deleted.
Line 17, "FIGURE," should read -- the FIGURE, --.

Column 6,
Line 9, "FIGURE," should read -- the FIGURE, --.

Signed and Sealed this

Fourteenth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,789,868 B2
DATED : September 14, 2004
INVENTOR(S) : Kenshi Hata et al.

It is certified that error appears in the above-identified patent and that said Letters Patent is hereby corrected as shown below:

Title page,
Item [75], Inventors, "Shigeru Watanable, Kanagawa (JP)" should read -- Shigeru Watanabe, Kanagawa (JP) --.

Signed and Sealed this

Twenty-ninth Day of March, 2005

JON W. DUDAS
*Director of the United States Patent and Trademark Office*